US007994722B2

(12) United States Patent
Garson et al.

(10) Patent No.: US 7,994,722 B2
(45) Date of Patent: Aug. 9, 2011

(54) ENERGY SAVING CONTROL FOR A FLUORESCENT LIGHT IN A MERCHANDISING MACHINE AND A METHOD OF RETROFITTING THE CONTROL IN A MERCHANDISING MACHINE

(75) Inventors: Brent D. Garson, Orange, OH (US); Glen Johnson, Cleveland, OH (US)

(73) Assignee: Vendors Exchange International, Inc., Cleveland, OH (US)

( * ) Notice: Subject to any disclaimer, the term of this patent is extended or adjusted under 35 U.S.C. 154(b) by 384 days.

(21) Appl. No.: 12/358,590

(22) Filed: Jan. 23, 2009

(65) Prior Publication Data

US 2010/0187997 A1 Jul. 29, 2010

(51) Int. Cl.
*H01K 7/00* (2006.01)

(52) U.S. Cl. ..... 315/76; 315/158; 315/175; 315/307; 315/56

(58) Field of Classification Search ..... 315/76, 315/158, 175, 307, 308, 320, 51, 56, 291
See application file for complete search history.

(56) References Cited

U.S. PATENT DOCUMENTS

| | | | | |
|---|---|---|---|---|
| 5,197,793 | A | 3/1993 | Stone | |
| 6,745,581 | B2 | 6/2004 | King et al. | |
| 6,801,836 | B2 * | 10/2004 | Schanin | 700/295 |
| 2003/0009264 | A1 | 1/2003 | Schanin | |
| 2004/0000154 | A1 | 1/2004 | Schanin | |
| 2004/0025389 | A1 * | 2/2004 | Peterson | 40/524 |
| 2008/0077275 | A1 | 3/2008 | Merwarth et al. | |

* cited by examiner

*Primary Examiner* — Rexford N Barnie
*Assistant Examiner* — Christopher Lo
(74) *Attorney, Agent, or Firm* — Tarolli, Sundheim, Covell & Tummino LLP

(57) ABSTRACT

An energy saving control 40 for a fluorescent light which is easily installed in an existing merchandising machine 10 and a method of retrofitting the energy saving control for a fluorescent light into an existing merchandising machine.

13 Claims, 3 Drawing Sheets

ENERGY SAVING CONTROL FOR A FLUORESCENT LIGHT IN A MERCHANDISING MACHINE AND A METHOD OF RETROFITTING THE CONTROL IN A MERCHANDISING MACHINE

BACKGROUND OF THE INVENTION

The present invention relates to a new and improved method and apparatus for retrofitting a merchandising machine with an energy efficient control for energizing existing fluorescent lights in the merchandising machine.

Merchandising machines include both vending machines which dispense a product in response to a customer inserting funds or a credit in the machine and selecting a product to be dispensed and glass front merchandising machines in which a customer accesses products displayed in a window in a door in the front of the merchandising machine by opening the door and selecting a product from the displayed products. The selected product is then taken to a cashier to pay for the product. In both the vending and glass front merchandising machine, fluorescent lights are utilized to illuminate the product to be dispensed. The fluorescent lights are continually energized as long as the merchandising machine is plugged in.

It is desirable to turn off the fluorescent lights when the merchandising machine is not in use to conserve energy. However, when a prospective purchaser is in proximity to the merchandising machine, it is important for the fluorescent lights to be energized to illuminate products to be vended to entice the potential customer to purchase a product. Some of the merchandising machines include refrigeration systems to chill product to be dispensed. These products must be continually refrigerated even when the fluorescent lights are turned off.

It is known to use human presence detection to deenergize compressors and lights in a vending machine when a sensor does not sense a human in proximity thereto. Such systems, such as discussed in U.S. Pat. No. 6,745,581 and U.S. Patent Application 20040000154, are available to conserve energy in new machines in which such controls have been incorporated. These new vending machines are designed with such controls in place but such controls are expensive and not readily retrofittable into existing merchandising machines.

SUMMARY OF THE INVENTION

The present invention provides a new and improved control for conserving energy and reducing energy usage of fluorescent lights in a merchandising machine which maybe easily retrofitted into existing merchandising machines which use fluorescent lights to illuminate products to be dispensed.

Typically, merchandising machines provide 110 volts to energize a ballast disposed in the machine which powers one or more fluorescent lights which illuminate products to be dispensed located in the machine. In existing older merchandising machines, the ballast and fluorescent light(s) are energized whenever the merchandising machine is plugged into a 110 volt power source such as a wall plug. The ballast is normally connected to a power source through a two-piece connector having a male and female member which can be separated to disconnect the ballast from the power source to allow the ballast to be replaced.

The energy saving control for conserving energy usage of fluorescent lights in a merchandising machine of the present invention is easily retrofitted into an existing merchandising machine by disconnecting the male and female members of the two-piece connector and plugging the new energy saving control into the disconnected male and female members of the existing two-piece connector.

The energy saving control for fluorescent lights of the present invention includes a detector which senses the presence of a human in proximity to the merchandising machine and which energizes the ballast and fluorescent light(s) in response to sensing a human in proximity to the merchandising machine. The control energizes the ballast and fluorescent light(s) as long as the detector senses the presence of a human in proximity to the merchandising machine and for a predetermined time period after a human is last sensed by the detector.

BRIEF DESCRIPTION OF THE DRAWINGS

The foregoing and other features of the present invention will become more apparent upon consideration of the following description taken in connection with the accompany drawings wherein.

DESCRIPTION OF A SPECIFIC EMBODIMENT OF THE INVENTION

Figure 1:
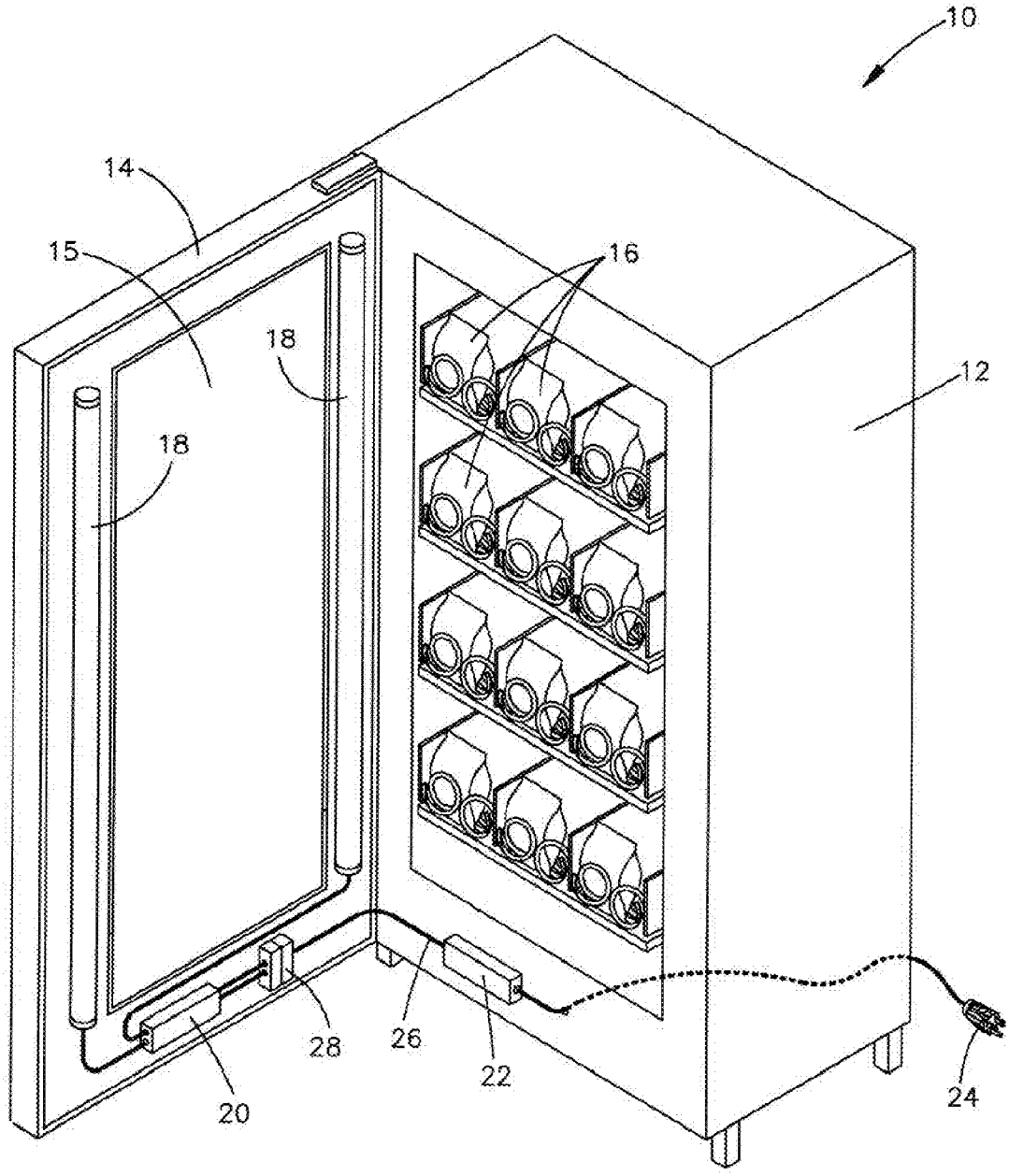
FIG. 1 is a schematic illustration of a typical prior art merchandising machine in which the present invention may be easily installed.

Referring to the figures and more particularly to FIG. 1, a merchandising machine 10 in which the present invention may be incorporated is disclosed. The merchandising machine 10 may be a vending machine which dispenses product 16 in response to a customer inserting funds or a credit into the machine 10, and then selecting a product 16 to be dispensed or may be a glass front merchandising machine 10 in which a customer accesses displayed products 16 located in the merchandising machine 10 by opening a door 14 at the front of the merchandising machine 10. The customer then selects the products 16 from the displayed products in the machine and takes the selected product 16 to a cashier to pay for the product. For illustrative purposes, FIG. 1 discloses a glass front merchandising machine 10 including a cabinet 12 having a door 14 which may be opened and closed to access a plurality of products 16 which are displayed in the merchandising machine 10. The door 14 includes a window 15 through which products 16 may be viewed. In the merchandising machine 10 of FIG. 1 a customer approaches the machine, views the products 16 displayed therein through the window 15, opens the door 14 and selects a product 16 which the customer then removes from the machine 10 and transports to a cashier where the customer pays for the product.

Typically one or more fluorescent lights 18 are located within the merchandising machine 10 to illuminate the products 16 to be dispensed. In the illustrated embodiment, a pair of fluorescent lights 18 are located on the interior of the door 14 and when energized illuminate product 16 to be dispensed from the merchandising machine 10. The fluorescent lights 18 may be located in the cabinet 16 rather than on the door 14. The fluorescent lights 18 are powered by a machine control 22 which is connected via a plug 24 to a source of power which normally is a 110 volt receptacle. The plug 24 supplies 110 volt power to the machine control 22 which in turn energizes the ballast 20 with 110 volts which energizes fluorescent lights 18. A two-wire conductor 26 connects the machine control 22 to the ballast 20 through a two-piece connector 28. The two-piece connector 28 includes a female member 32 and a male member 34 which is adapted to be received in the female member 32 to provide a conductive path through the two-piece connector 28 to effect energization of the ballast 20 and fluorescent lights 18 from the machine control 22.

The connector 28 may be a two-piece latching connector including a pawl 36 on the female member 32 and a latch 38 on the male member 34. The latch 38 engages with and latches to the pawl 36 when the female member 32 engages with and receives the male member 34 therein to prevent the female member 32 and male member 34 from unlatching without positive movement of the pawl 36 away from the latch 38. The two-piece connector 28 may be of the type manufactured by AMP/TYCO having housing numbers 1-480698-0 and 1-480699-0. Additionally, connectors such as those manufactured by Molex could also be utilized. While a snap to connect or latching connector 28 has been illustrated other connectors could be utilized without departing from the scope of the present invention.

Figure 2:
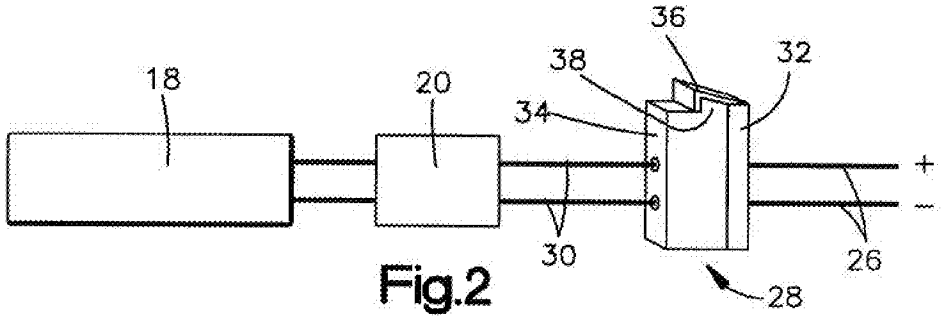
FIG. 2 is a schematic diagram illustrating the typical prior art two-piece connector, the ballast and the fluorescent light for illuminating merchandise within the merchandising machine of FIG. 1.

FIG. 2 more fully illustrates the circuitry for energizing the fluorescent light 18 and ballast 20 including the two-wire conductor 26 and the two-piece connector 28. In the circuitry of FIG. 2, the fluorescent light 20 and ballast 18 are constantly energized by the two wire conductor 26 whenever the merchandising machine 10 is plugged into a source of 110 volt power.

It is desirable to be able to deenergize the fluorescent light 18 and the ballast 20 when a human is not in proximity to the merchandising machine 10. Deenergization of the ballast 20 and fluorescent light 18 when the machine 10 is not in use, conserves energy. In one known merchandising machine manufactured by Dixie Narco an energy savings of 119 watts per hour was realized by deenergizing the fluorescent lights and ballast. Deenergization of the ballast and the fluorescent light can result in an energy savings of in excess of 750 KWHs watts per year per merchandising machine 10. Actual watts saved is dependent upon the exact merchandising machine to be retrofitted and the percentage of the time that the fluorescent light and ballast are deenergized.

Figure 3:
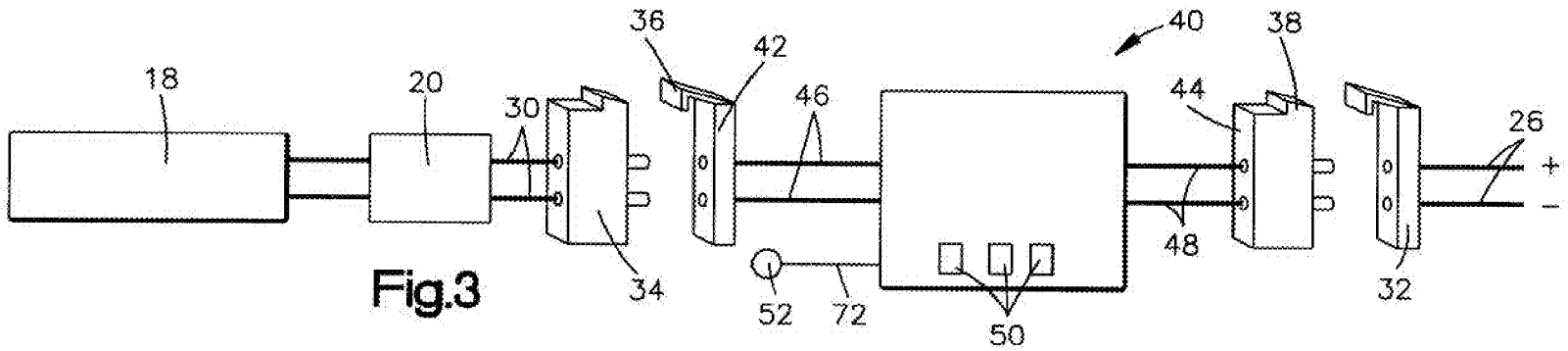
FIG. 3 is a schematic diagram similar to FIG. 2 illustrating the two-piece connector of FIG. 2 in a disconnected condition in which the male member is disconnected from the female member and the energy saving control for a fluorescent light in a position to plug into the disconnected male and female members of the two-piece connector.
Figure 4:
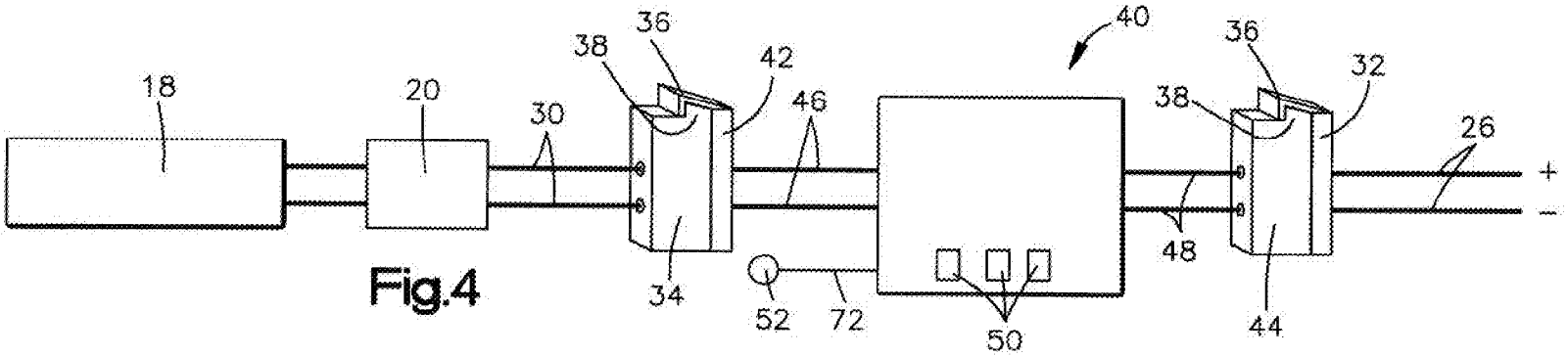
FIG. 4 is a schematic diagram similar to FIG. 3, illustrating the energy saving control for a fluorescent light plugged into the disconnected male and female members of the two-piece connector to control energization of the ballast and fluorescent light.

The present invention utilizes a control 40 which is easily retrofittable into an existing merchandising machine 10 and which provides an energy saving control for the fluorescent light(s) 18 which is utilized to illuminate products 16 displayed in the merchandising machine 10. The control 40 (see FIGS. 3-5) includes a power conditioning section 56 having a male connector 44 connected thereto via conductors 46, a controller 58 having a female connector 42 connected to the controller 58 by conductors 48 and a detector 52. The male connector 44 is substantially identical to the male connector 34 of the first two-piece connector 28 which allows the male connector 44 to be readily connected to and received in the female connector 32 of the first two-piece connector 28. The female connector 42 is identical to the female connector 32 of the first two-piece connector 28 which enables the female connector 42 to readily engage and connect to the male connector 34 of the first two-piece connector 28. The female connector 42 and male connector 44 may be of the type manufactured by AMP/TYCO having housing members 1-480698-0 and 1-480699-0.

Other types of connectors could be utilized without departing from the scope of the present invention, including a pair of male and a pair of female single wire connectors, as long as the connectors are connectable to the male and female members 34,32 of the first two piece connector 28. Typically, the male and female members 44, 42 will be identical to the male and female members of 34,32 of the first two piece connector 28 to insure connectability. The male and female connectors 44,42 are sometimes referred to herein as a second two piece connector because the male connector 44 is adapted to be received in the female connector 42, although the male and female connectors 44,42 are not connected together in the present energy saving control 40.

The energy saving fluorescent light control 40 is easily retrofittable into an existing merchandising machine by disconnecting the male connector 34 and female connector 32 of the first two-piece connector 28 and connecting the male connector 44 connected to the control 40 into the female connector member 32 of the first two-piece connector 28 and connecting the female connector 42 to the male connector member 34 of the first two-piece connector 28. Connecting the male and female connectors 44, 42 into the male and female connectors 34, 32 of the first two-piece connector 28 enables the control 40 to energize and deenergize the ballast 20 and fluorescent lights 18. The use of male and female connectors 44, 42 to retrofit the control 40 into an existing merchandising machine 10 prevents the control 40 from being installed incorrectly as the male and female connectors 44, 42 can only be connected one way into the male and female members 34, 32 of the first two-piece connector 28.

The control 40 includes a detector 52 which is a human presence detector which is operable to sense the presence of a human in proximity to the merchandising machine 10. The human presence detector 52 may be a ten meter motion detector such as that available from Panasonic under Model No. AMN 34111 which is a passive infrared type. The motion detector 52 provides a signal which enables the control 40 to energize the ballast 20 and fluorescent light 18 when the motion detector 52 senses the presence of a human in proximity to the merchandising machine 10. The detector 52 sends a signal on line 72 whenever a human is sensed by the detector 52 in proximity to the merchandising machine 10. The control 40 energizes the ballast 20 and fluorescent light 18 as long as it receives a signal from the detector 52 indicating the presence of a human in proximity to the merchandising machine 10 and for a predetermined period of time after the detector 52 last senses the presence of a human in proximity to the merchandising machine. The control 40 includes a plurality of inputs, such as dip switches 50, which can be utilized to set the predetermined time period that the control 40 energizes the fluorescent light 18 and ballast 20 after the detector 52 last senses the presence of a human in proximity to the merchandising machine 10. While dip switches 50 have been illustrated to set the predetermined time period that the control 40 energizes the fluorescent light 18 and ballast 20 after the detector 52 last senses the presence of a human in proximity to the merchandising machine 10, other inputs such as potentiometers or memory sticks could be used.

Figure 5:
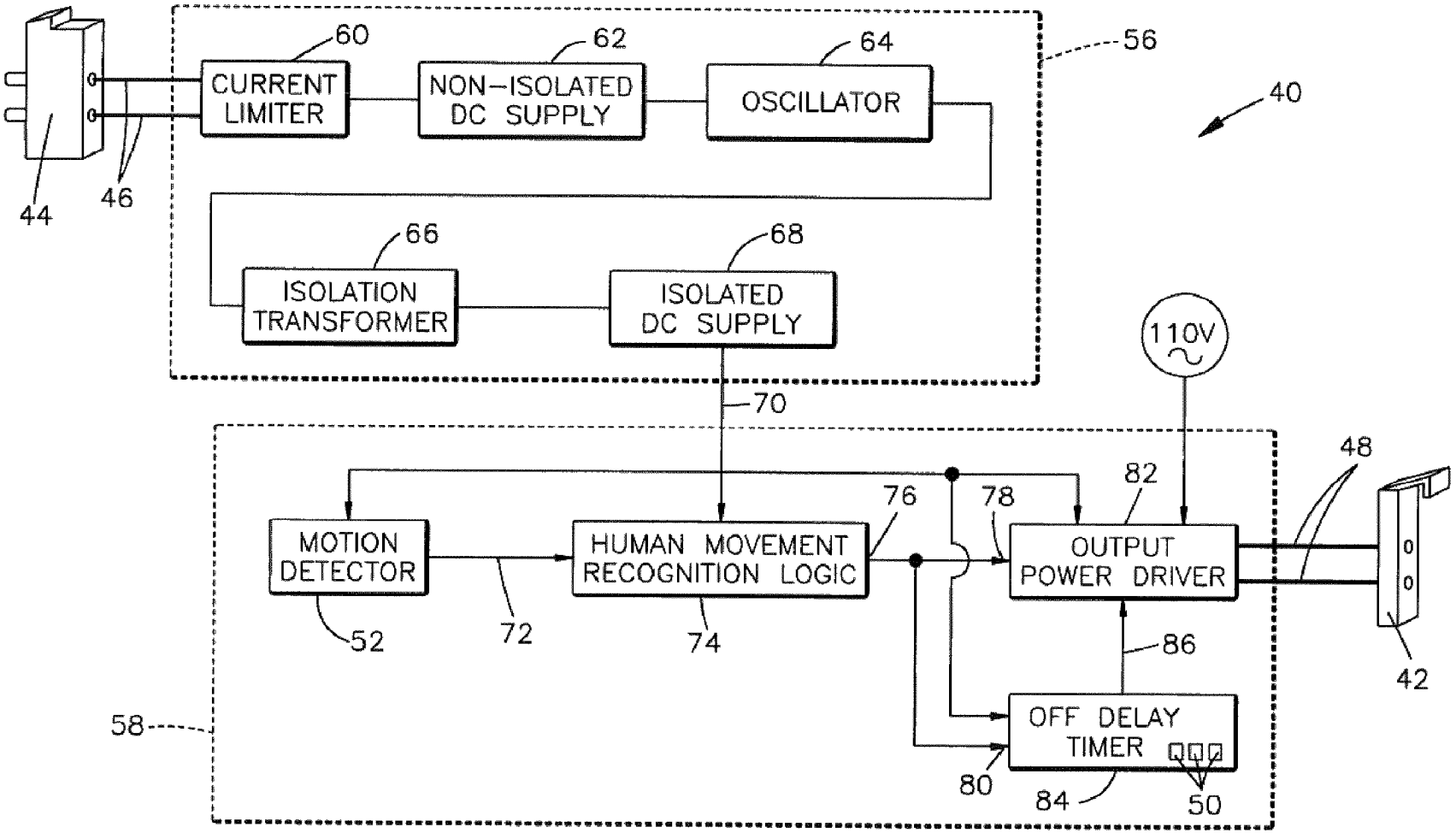
FIG. 5 is a block diagram of the energy saving control for the ballast and fluorescent light.

The control 40, more fully illustrated in FIG. 5, includes power conditioning section 56, controller 58 and detector 52. The power conditioning section 56 includes a current limiter 60, a non-isolated DC supply 62, an oscillator 64, an isolation transformer 66 and an isolated DC supply 68. The power conditioning section 56 is connected to and receives power from the male connector 44 which is connectable to the female connector 32 of the first two-piece connector 28. The connector 44 directs power through current limiter 60 whose output is connected to a non-isolated DC supply 62. The output of the non-isolated DC supply 62 is directed to an oscillator 64 whose output is connected to an isolation transformer 66. The isolation transformer 66 includes an output which is connected to an isolated DC power supply 68. The isolated DC power supply supplies isolated power on an output 70 which is connected to the controller 58 and to the motion detector 52 to power the controller 58 and motion detector 52.

The detector 52 which in the present embodiment is a motion detector 52 senses the presence of a human in proximity to the merchandising machine 10. The motion detector 52 provides an output signal on line 72 whenever the motion detector 52 detects motion in proximity to the merchandising machine 10. The output of the motion detector 52 is directed along line 72 to human movement recognition logic 74 which determines whether the output from the motion detector 52 is attributable to a human in proximity to the merchandising machine 10. While the human recognition logic is depicted in FIG. 5 as a separate circuit, the logic can be incorporated in the motion detector 52. An output power driver 82 for directing 110 volts to the connector 42 to power the ballast 20 and fluorescent light 18, and an off delay timer 84 are connected to the output 76 of the human recognition logic 74.

The off delay timer 84 is utilized to turn off the output from the output power driver 82 to deenergize the ballast 20 and fluorescent light 18.

When the motion detector 52 senses the presence of a human in proximity to the merchandising machine 10, a signal is established on line 72 which is directed to the human movement recognition logic 74. The human movement recognition logic 74 analyzes the signal from the motion detector 52 and if the logic determines that the signal is a result of the presence of a human in proximity to the merchandising machine 10, then the human movement recognition logic 74 will establish a periodic signal on line 76 as long as the motion detector 52 continues to sense the presence of a human in proximity to the merchandising machine 10. The signal on line 76 is directed to an input 78 of the output power driver 82 and to an input 80 of the off delay timer 84. When output power driver 82 receives a signal on its input 78 from the human movement recognition logic 74, the output power driver 82 will switch 110 volt power and supply such power through the female connector 42 which is connected to the male connector 34 of the first two-piece connector 28 to energize the ballast 20 and fluorescent light 18. The output power driver 82 will continue to energize the ballast 20 and fluorescent light 18 until it receives a signal from the off delay timer 84 which tells the output power driver 82 to deenergize ballast 20 and fluorescent light 18.

The human recognition logic 74 applies periodic signals on line 76 to the input 80 of the off delay timer 84 as long as the detector 52 continues to sense the presence of a human in proximity to the merchandising machine 10. The off delay timer 84 is operable to establish a signal on line 86 to signal output power driver 82 to deenergize the ballast 20 and fluorescent light 18.

The off delay timer 84 establishes the signal on line 86 after a predetermined time period after the motion detector 52 last senses the presence of a human in proximity to the merchandising machine 10. When a human is no longer sensed by the motion detector 52, the human movement recognition logic 74 will no longer establish a periodic signal on line 76. When the periodic signal from the human recognition logic 74 stops at the input 80 to the off delay timer 84, the off delay timer 84 will start to time out and after a predetermined time period will establish a signal on line 86 to switch the output power driver 82 to deenergize ballast 20 and fluorescent light 18. The off delay timer 84 includes a plurality of dip switches 50 which can be used to set the time period, measured from the last periodic signal sent from the human movement recognition logic 74 indicating the presence of a human in proximity to the merchandising machine 10, after which the off delay timer 84 sends a signal on line 86 to the output power driver 82 to effect the deenergization of the ballast 20 and fluorescent lights 18. It should be appreciated that the off delay timer 84 could utilize other inputs such as a potentiometer to set the off delay time period.

When the control 40 is installed in a merchandising machine 10 it is desirable to locate the motion detector 52 in a position in which the motion detector 52 can readily sense the presence of a human in proximity to the merchandising machine 10. In many instances it is desirable to create an opening in the merchandising machine 10 in which to locate the detector 52. The opening may be a hole drilled in the door 14 of the machine which allows the detector 52 to be mounted in the hole so that a sensing portion extends through the front of the door 14 in a position in which it is adapted to sense a human in proximity to the merchandising machine 10.

From the foregoing it should be apparent that a new and improved fluorescent light control 40 for retrofitting into an existing merchandising machine 10 which includes a fluorescent light 18 for illuminating products 16 located in the merchandising machine 10 has been disclosed. A ballast 20 having an input and an output connected to a fluorescent light 18 supplies power to the fluorescent light. The input of the ballast 18 is connected to a source of power through a two-piece first connector 28 having a first male member 34 and a first female member 32 which is adapted to receive and connect with the first male member 34. Power is conducted from a source of power through the first two-piece connector 28 to the ballast 20 to energize the fluorescent light 18. The florescent light control 40 includes a controller 58 for controlling the flow of power to energize and deenergize the fluorescent light and the ballast 20, a two-piece second connector having a second male member 44 and a second female member 42 with the second male member 44 being connectable to the first female member 32 of the first connector after the first male member 34 is disconnected from the first female member 32 of the first connector 28 and a second female member 42 being connectable to the first male member 34 of the first connector 28 after the first male member 34 is disconnected from the first female member 32 of the first connector 28. The control is connectable to one of the second male 44 and second female 42 members of the two-piece second connector to direct power to the control and is connected to the other of the second male and female connectors to direct power from the control to the ballast 20 and fluorescent light 18. The control 40 includes a detector 52 connected to the controller 58 for sensing the presence of a human in proximity to the merchandising machine 10. The controller 58 effects energization of the ballast 20 and fluorescent lights 18 in response to the detector 52 sensing a human in proximity to the merchandising machine 10 and effects deenergization of the ballast 20 and fluorescent light 18 in response to the detector 52 not sensing the presence of a human in the vicinity of the merchandising machine 10.

The present invention further provides a method of retrofitting an energy saving fluorescent light control 40 into an existing merchandising machine 10 which includes the steps of placing the energy saving fluorescent light control 40 including a detector 52, a controller 58 and a two-piece second connector including a second male member 44 and a second female member 42 in the merchandising machine 10, disconnecting the first female member 32 from the first male member 34 of the two-piece first connector 28, connecting the second male member 44 of the second connector to the first female member 32 of the first connector 28, connecting the second female member 42 of the second connector to the first male member 34 of the first connector, and locating the detector 52 in a position to sense the presence of a human in proximity to the merchandising machine 10 to enable the controller 58 to energize the ballast 20 and fluorescent light 18 in response to the detector 52 sensing the presence of a human in proximity to the merchandising machine 10 and deenergizing the ballast 20 and fluorescent light 18 after a predetermined time period after the detector 52 last senses the presence of a human in proximity to the merchandising machine 10.

The invention claimed is:

1. A fluorescent light control for retrofitting into a existing merchandising machine which includes a fluorescent light for illuminating products located in the merchandising machine, a ballast having an input and an output connected to the fluorescent light to supply power to the fluorescent light, the input of the ballast being connected to a source of power through a two-piece first connector having a first male member and a first female member which is adapted to receive and connect with the first male member when the first male member is received in the first female member and power is conducted from the source of power through the two-piece first connector, to the ballast to energize the fluorescent light, said fluorescent light control comprising a controller for controlling the flow of power from the source of power to the ballast to energize and deenergize the fluorescent light and the ballast, a two-piece second connector having a second male member and a second female member, said second male member being connectable to said first female member of said first connector after said first male member is disconnected from said first female member of said first connector and a second female member being connectable to said first male member of said first connector after said first male member is disconnected from said first female member of said first connector, said control being connectable to one of said first male and first female members of said two-piece first connector to direct power from said source of power to said control, said control being connected to the other of said first male and first female members of said two-piece first connector to direct power from said control to the ballast and the fluorescent light, and a detector connected to said controller for sensing the presence of a human in proximity to the merchandising machine and providing a signal to said controller indicative of the presence of a human said controller effecting energization of the ballast and fluorescent lights in response to said detector sensing a human in proximity to the merchandising machine and effecting deenergization of the ballast and fluorescent light in response to said detector not sensing the presence of a human in the vicinity of the merchandising machine.

2. The fluorescent light control for retrofitting into an existing merchandising machine which includes a fluorescent light as defined in claim 1, wherein said detector is a motion detector for detecting the presence of a human in proximity to the merchandising machine.

3. The fluorescent light control for retrofitting into an existing merchandising machine which includes a fluorescent light as defined in claim 1, wherein said controller effects deenergization of the ballast and fluorescent light after a predetermined time period after the detector last senses the presence of a human in proximity to the merchandising machine.

4. The fluorescent light control for retrofitting into an existing merchandising machine which includes a fluorescent light as defined in claim 2, wherein said motion detector sends a signal to said controller whenever a human is in proximity to the merchandising machine.

5. The fluorescent light control for retrofitting into an existing merchandising machine which includes a fluorescent light as defined in claim 4, wherein said controller includes a timer which generates a signal after a predetermined time after said motion detector last senses the presence of a human in proximity to the merchandising machine to effect deenergization of the ballast and fluorescent light.

6. The fluorescent light control for retrofitting into an existing merchandising machine which includes a fluorescent light as defined in claim 5, wherein said signal sent by said motion detector to said controller prevents said timer from generating said signal to effect deenergization of the ballast and fluorescent light.

7. The fluorescent light control for retrofitting into an existing merchandising machine which includes a fluorescent light as defined in claim 5, further including an input to said timer to set the predetermined time, measured from the last signal sent from the motion detector indicating the presence of a human in proximity to the merchandising machine, after which said timer generates said signal to effect deenergization of the ballast and fluorescent light.

8. A method of retrofitting an energy saving fluorescent light control into an existing merchandising machine having a fluorescent light for illuminating products located in the merchandising machine, a ballast having an input and an output for supplying power to the fluorescent light, the output of the ballast being connected to the fluorescent light, the input of the ballast being connected to a source of power through a two-piece first connector having a first male member and a first female member which is adapted to receive and connect with the first male member when the first male member is received in the first female member and power is conducted from the source of power through the two-piece first connector and to the ballast to power the ballast and the fluorescent light, said method of retrofitting an energy saving fluorescent control into a merchandising machine includes the steps of:

placing an energy saving fluorescent light control including a controller for energizing and deenergizing the ballast and fluorescent light, a detector connected to said controller and a two-piece second connector including a second male member and a second female member both of which are connected to said control in the merchandising machine;

disconnecting the first female member from the first male member of the two-piece first connector;

connecting the second male member of the second connector to the first female member of the first connector;

connecting the second female member of the second connector to the first male member of the first connector;

locating the detector in a position to sense the presence of a human in proximity to the merchandising machine to enable the detector to send a signal to the controller indicating the presence of a human in proximity to the merchandising machine to enable the controller to energize the ballast and fluorescent light from the source of power in response to the detector sensing the presence of a human in proximity the merchandising machine and to enable the controller to denergizing the ballast and fluorescent light after a predetermined time period after the detector last senses the presence of a human in proximity to the merchandising machine.

9. The method of retrofitting an energy saving fluorescent light control into an existing merchandising machine having a fluorescent light for illuminating products located in the merchandising machine as defined in claim 8, wherein said step of locating the detector in a position to sense the presence of a human in proximity to the merchandising machine includes the steps of creating an opening in the merchandising machine and locating the detector in said opening in a position which enables the detector to sense the presence of a human in proximity to the merchandising machine.

10. The method of retrofitting an energy saving fluorescent light control into an existing merchandising machine having a fluorescent merchandise located in the merchandising machine as defined in claim 8, wherein said step of providing a detector to sense the presence of a human in proximity to the merchandising machine includes the step of providing a motion detector which provides a signal to the controller whenever a human is in proximity to the merchandising machining.

11. The method of retrofitting an energy saving fluorescent light control into an existing merchandising machine having a fluorescent light for illuminating merchandise located in the merchandising machine as defined in claim 8, wherein said step of deenergizing the ballast and fluorescent light after a predetermined time period after the detector last senses the presence of a human in proximity the merchandising machine further includes the step of selecting the predetermined time period after the detector last senses the presence of a human in proximity to the merchandising machine after which the controller denergizes the ballast and fluorescent light.

12. The method of retrofitting an energy saving fluorescent light control into an existing merchandising machine having a fluorescent light for illuminating products located in the merchandising machine as defined in claim 8, wherein said step of providing a detector including the steps of providing a motion detector, forming an opening in the merchandising machine and locating the motion detector in the opening to sense the presence of a human in proximity to the merchandising machine.

13. The method of retrofitting an energy saving fluorescent light control into an existing merchandising machine having a fluorescent light for illuminating products located in the merchandising machine as defined in claim 12, wherein said step of forming an opening in the merchandising machine includes the step of drilling a hole in the merchandising machine and locating the motion detector in the hole to sense the present of a human in proximity to the merchandising machine.

* * * * *